US006028420A

United States Patent [19]

Benes

[11] Patent Number: 6,028,420

[45] Date of Patent: Feb. 22, 2000

[54] CONSTANT VOLTAGE POWER SUPPLY WITH CONTINUITY CHECKING

[75] Inventor: Michael J. Benes, Irvington, N.J.

[73] Assignee: Hewlett-Packard Company, Palo Alto, Calif.

[21] Appl. No.: 09/098,759

[22] Filed: Jun. 17, 1998

[51] Int. Cl.[7] ..... G05F 1/569

[52] U.S. Cl. ..... 323/276; 361/89

[58] Field of Search ..... 323/275, 276, 323/277, 278, 279, 280; 361/18, 89, 90, 91, 92, 115

[56] References Cited

U.S. PATENT DOCUMENTS 4,155,036 5/1979 Nicholson ..... 324/73 R
4,349,745 9/1982 Adams et al. ..... 307/12

*Primary Examiner*—Y. J. Hjan

[57] ABSTRACT

A constant voltage power supply includes one or more sense leads connected to a load and in a feedback control loop. The voltage at the load is fed back via the sense leads for comparison to a reference voltage in the loop to generate an error signal that adjusts the voltage output of the power supply to achieve and maintain the voltage delivered to the load constant at a desired value. The power supply further includes a continuity checking circuit for checking continuity status of the sense leads while the power supply is in a disable mode wherein it is isolated from the load. This allows any detected discontinuity to be repaired before the supply is connected to a load. The detected discontinuity informs the user that the voltage delivered to the load will not be accurately controlled because of the broken or disconnected sense lead. Without the continuity checking circuit, the user would think that the voltage at the load is an accurate replica of the desired load voltage as represented by the reference voltage.

12 Claims, 1 Drawing Sheet

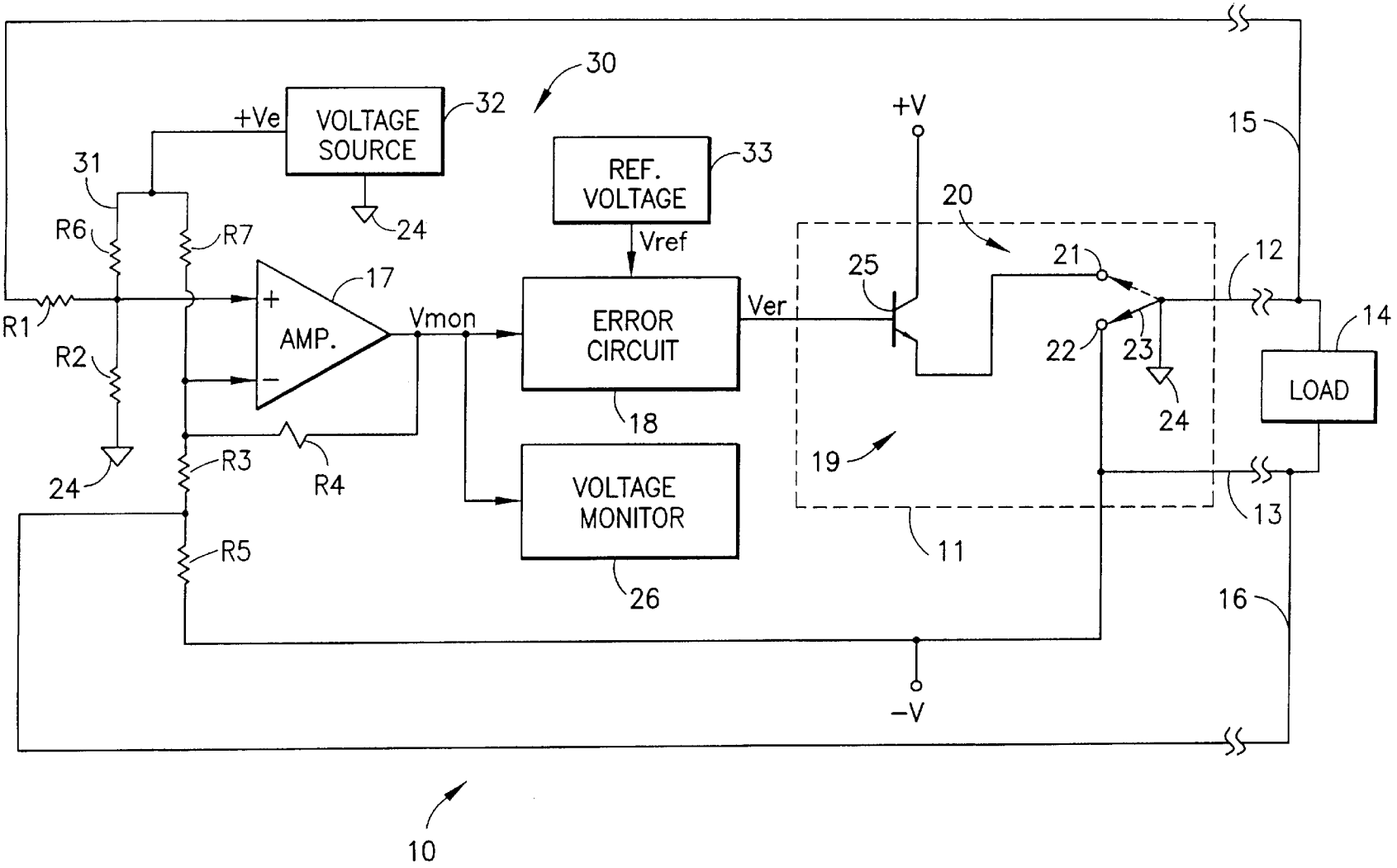
LOAD
14
15
12
13
16
24
23
21
22
20
+V
25
19
11
-V
Ver
33
REF. VOLTAGE
Vref
ERROR CIRCUIT
18
VOLTAGE MONITOR
26
30
32
VOLTAGE SOURCE
24
Vmon
17
AMP.
R4
+Ve
R7
R3
R5
31
R6
R2
24
R1
10

CONSTANT VOLTAGE POWER SUPPLY WITH CONTINUITY CHECKING

FIELD OF INVENTION

This invention relates to continuity checking in electrical circuitry and, in particular, to a constant voltage power supply having a circuit for checking continuity in one or more sense leads of the power supply.

BACKGROUND OF INVENTION

A discontinuity in an electrical circuit path or lead can result from a break in the lead, a faulty connection, a faulty component, and the like. The result is an open circuit that will not conduct current and, hence, a failure in the apparatus in which the circuit path is connected.

Constant voltage power supplies are designed to maintain a constant voltage to a load that may be located some distance (for example, tens of feet) from the power supply. To maintain a constant voltage at the load, the design must consider a number of concerns, including the voltage drop across the length of wire between the power supply and the load, and current demands of the load itself.

A design that accommodates these concerns employs one or more sense leads connected to the load and connected in a feedback control loop. The voltage at the load is fed back via the sense leads for comparison to a reference voltage. A difference voltage determined as a result of the comparison enables generation of an error signal that is used to adjust the voltage output of the power supply to achieve and maintain the voltage delivered to the load constant. A break or open circuit in the sense leads prevents the power supply from delivering a constant voltage to the load and may even result in an overvoltage condition that damages the load.

To prevent an overvoltage, a prior art scheme involves the connection of sense protect resistors between the sense leads and the local output leads of the power supply. However, this scheme does not detect a discontinuity in a sense lead. Although the sense protect resistors prevent the overvoltage situation, an undetected discontinuity in a sense lead will cause the power supply's output voltage to change and to have poor voltage regulation.

Some prior solutions to the continuity checking problem have used complicated schemes to separately measure the resistance between a positive sense lead and the positive output lead, and between the negative sense lead and the negative output lead. These solutions have involved the use of costly measuring devices or labor intensive procedures.

Accordingly there is a need for a constant voltage power supply having a circuit that checks for continuity in the sense leads of the power supply. In particular, there is a need for such a circuit that allows checking of the sense lead status before enabling the output of the power supply, so as to prevent possible overvoltage damage to a load.

SUMMARY OF INVENTION

A constant voltage power supply according to the invention includes one or more sense leads connected to a load and to a feedback control loop. The voltage at the load is fed back via the sense leads for comparison to a reference voltage to enable generation of an error signal that is used to adjust the voltage output of the power supply to achieve and maintain constant the voltage delivered to the load. The power supply further includes a continuity checking circuit for checking continuity status of the sense leads while the power supply is in a disable mode, wherein it is isolated from the load. This allows any detected discontinuity to be repaired before the supply is connected to a load, thereby guaranteeing accurate voltage at the load and eliminating overvoltage damage to the load.

A continuity checking circuit according to the present invention includes a voltage source and a resistor network that are operative with the standard monitor amplifier of a feedback control loop to check sense lead continuity status and to provide an indication thereof in the output voltage of the amplifier.

The voltage source and resistor network are operative to detect continuity conditions in at least one sense lead and to provide an indication thereof by causing the monitor amplifier output voltage to have different values depending on the continuity status of the sense leads.

BRIEF DESCRIPTION OF DRAWINGS

Other advantages and features of the present invention will be understood by reference to the following specification in conjunction with the accompanying drawing, in which the sole FIGURE is a block diagram, in part, and an electrical circuit diagram, in part, of a constant voltage power supply that embodies the invention.

DESCRIPTION OF PREFERRED EMBODIMENT

With reference to the FIGURE, a constant voltage power supply 10 has a power stage 11 that receives an unregulated d.c. voltage at connectors +V and −V from a standard d.c. voltage source (not shown). Power stage 11 provides an operating voltage via a first output lead 12 and a second output lead 13, respectively. Output leads 12 and 13 are adapted for connection to a load 14 that may be located adjacent to power supply 10 or many feet away as represented by the breaks, in output leads 12 and 13.

The standard d.c. voltage source, for example may comprise a transformer, full wave rectifier and a filter capacitor for converting an a.c. voltage to an unregulated d.c. voltage that is floating with respect to circuit common.

Power stage 11 has an enable mode wherein it provides an operating voltage to first and second output leads 12 and 13, and a disable mode wherein it is isolated from first and second output leads 12 and 13. To this end, power stage 11 includes an output stage 19 and an enable/disable switch 20. In the enable mode, output stage 19 responds to an error signal Ver to convert the unregulated d.c. voltage to a desired operating voltage. Enable/disable switch 20 has an enable contact 21, a disable contact 22 and a switch pole 23. When switch pole 23 is in contact with enable contact 21, power stage 11 is in the enable mode. When switch pole 23 is in contact with disable contact 22, power stage 11 is in the disable mode. For the illustrated embodiment, output lead 12 serves as circuit common as indicated on the drawing by the symbol 24.

Due to the distance between output stage 11 and load 14, there may be degradation or loss of voltage over the length of output leads 12 and 13. To assure that the operating voltage at the load is maintained at a desired value, there are provided a first and a second sense lead 15 and 16, respectively. First and second sense leads 15 and 16 are connected at the location of load 14 to first and second output leads 12 and 13, respectively. First and second sense leads 15 and 16 are also connected in a feed back loop that includes a monitor amplifier 17 and an error circuit 18. First and second sense leads 15 and 16 are shown with breaks to indicate the distance between load 14 and power supply 10.

The operating voltage at the location of load 14 is fed back via first and second sense leads 15 and 16 and monitor amplifier 17 to an error circuit 18. Error circuit 18 compares the fed back operating voltage with a reference voltage Vref supplied by reference voltage source 33 to generate error signal Ver that is used by power stage 11 to adjust and maintain the operating voltage constant at a desired value at load 14. A voltage monitor 26 is connected to receive an output voltage Vmon of monitor amplifier 17. Voltage monitor 26 provides a visual display of voltage Vmon.

By way of example, output stage 19 is shown as comprising an NPN transistor 25 having its base connected to receive error signal Ver, its collector connected to the +V connector and its emitter connected via switch contact 21 and switch pole 23 to output lead 12. Thus, in the enable mode there is a series circuit including the unregulated d.c. voltage source +V and −V, the collector/emitter path of transistor 25, output lead 12, load 14 and output lead 13.

For a typical application, consider an unregulated d.c. voltage of 20 volts and a desired operating voltage of 5 volts. The design is such that error signal Ver causes transistor 25 to turn on enough to cause a 15 volts drop across its collector/emitter path to circuit common 24 of first output lead 12. Applying Kirchoff's law and assuming a circuit common of 0 volt, the collector of transistor 25 and +V connector are at +15 volts and the −V connector is at −5 volts. This provides an output voltage Vout=5 volts across first and second output leads 12 and 13 at the power supply 10.

Techniques other than the enable/disable switch 20 may be used to place the power supply 10 in the enable and disable modes. What is necessary to change from the enable mode to the disable mode is to prevent the application of voltage from power stage 11 to the output leads 12 and 13. In another preferred embodiment, this is accomplished by disabling transistor 25 by either interrupting its bias connections or disconnecting its collector from the unregulated d.c. voltage +V. Another way to prevent application of voltage to the output leads 12 and 13 is to disable the error circuit 18. For these alternate techniques, a bleeder resistor may be connected across load 14 to provide a current path for leakage current.

Any break or discontinuity in either of the sense leads 15 or 16 interrupts the feed back loop and renders the constant voltage control inoperative. Such a break can cause error circuit 18 to adjust the error signal Ver in a manner that will cause power stage 11 to produce a higher than necessary operating voltage that results in an overvoltage condition at load 14. This could damage load 14. Accordingly, it is desirable to detect and fix discontinuities, breaks or opens in sense leads 15 and 16.

In accordance with the present invention, power supply 10 is provided with a circuit 30 for checking the continuity status of first and second sense leads 15 and 16. Continuity checking circuit 30 is operable during the disable mode, regardless of whether load 14 is connected across first and second output leads 12 and 13.

Continuity checking circuit 30 includes monitor amplifier 17, a resistor network 31 and a source of voltage 32. Voltage source 32 provides a voltage +Ve to resistor network. 31. Voltage source 32 is referenced to circuit common 24 and may also provide bias voltages to monitor amplifier 17, error circuit 18, voltage monitor 26 and power stage 11 via connections not shown on the drawing. Voltage source 32 may be separate from the source of unregulated d.c. voltage or may be derived therefrom.

Resistor network 31 includes resistors R1 through R7. Resistor network 31 and voltage source 32 are operable in the disable mode to provide continuity voltages at the plus and minus inputs of monitor amplifier 17 that have values corresponding to the continuity status of the sense leads 15 and 16. During the disable mode, switch pole 23 engages contact 22. This results in output leads 12 and 13 and sense leads 15 and 16 all being connected to circuit common.

In a first continuity state, there is continuity in both sense leads 15 and 16. Current flows from voltage source 32 through two voltage dividing paths to circuit common. The first current path is through resistor R6 and the parallel combination of resistors R1 and R2. A first continuity voltage is taken from the juncture of resistor R6 and R2 and applied to the plus input of monitor amplifier 17. The second current path to circuit common is through resistor R7 and R3. A second continuity voltage is taken from the juncture of resistor R7 and R3 and applied to the minus input of monitor amplifier 17. The second current path also includes current flow through resistor R4 that serves as the amplifier feedback resistor. By selecting appropriate values for these resistors, the first and second continuity voltages are balanced and Vmon has a first value. In a preferred design, R1=(K)R3, R2=(K)R4 and R6=(K)R7, where K is not zero.

In a second continuity state, sense lead 15 has discontinuity and sense lead 16 has continuity. Resistor R1 is now out of the first current path. The first continuity voltage goes more positive, resulting in Vmon assuming a second different value.

In a third continuity state, sense lead 15 has continuity and sense lead 16 has discontinuity. This changes the second current path to also include resistor R5. This causes the second continuity voltage to go more positive which translates through monitor amplifier 17 in Vmon assuming a third value different from the first and second values.

In a fourth continuity state, both sense leads 15 and 16 have a discontinuity. This changes both current paths as described above for continuity states two and three. This causes the first and second continuity voltages to go more positive with the first continuity voltage having the greater change. The result is that Vmon has a fourth value that is different from the first, second and third values.

By way of example, a preferred design for the illustrated embodiment uses the following parameters: Ve=10.3 volts, K=2, and resistor values in kilohms of R1=30, R2=9, R3=15, R4=4.5, R5=10. R6=20, and R7=10.

For these parameters and with the output voltage disabled (Vout=0), the Vmon voltage equations and values for the four continuity states are as follows:

| Continuity State | Vmon Equations | Vmon values |
|---|---|---|
| One-continuity in both 15 and 16 | $\frac{(Vout)R4}{R3}$ | approximately zero |
| Two-discontinuity in 15 | $\frac{Ve(R4)^2}{R3(R4+R7)}$ | +0.96 Volt |
| Three-discontinuity in 16 | $\frac{-(Ve)(R4)(R5)(Rp)}{(R3)(R7)(R3+R5)}$ | −0.32 Volt |

-continued

| Continuity State | Vmon Equations | Vmon values |
|---|---|---|
| Four-discontinuity in 15 and 16 | $\frac{Ve(R4)^2}{(R3+R5)(R4+R7)}$ | +0.58 Volt |

In the above table, Rp is defined as:

$$\frac{1}{\frac{1}{R3}+\frac{1}{R4}+\frac{1}{R7}}.$$

In comparison with the prior art sense protect resistor scheme, an advantage of the continuity checking circuit is that continuity can be checked before enabling the power supply. Any detected discontinuities can be fixed prior to enabling the power supply 10. This eliminates inaccurate voltages at the load that result even if sense protect resistors are present. The sense protect resistors limit the magnitude of the inaccuracy so as to ensure the load is not damaged. However, the inaccuracy present with a broken sense lead is of sufficient magnitude to result in improper operation of the load. The continuity checking feature uses a number of already existing parts of the power supply with the addition of resistors R6 and R7 and voltage Ve that may be derived from the usual bias voltage supply. Moreover, the addition of resistors R6 and R7 and voltage Ve does not materially affect the operation of the power supply in the enable mode, particularly for the preferred designs.

The present invention having been thus described with particular reference to the preferred forms thereof, it will be obvious that various changes and modifications may be made therein without departing from the spirit and scope of the present invention as defined in the appended claims. For example, the circuit common could be applied to output lead 13 instead of output lead 12.

What is claimed is:

1. A constant voltage power supply including (a) an output that is adapted to be connected to a load, (b) a power stage coupled to said output and having an enable mode wherein an operating voltage is applied to said output, and a disable mode wherein said power stage is isolated from said output and (c) a control loop including a sense lead coupled to said output for monitoring said operating voltage and providing an error signal to said power stage for maintaining said operating voltage constant, said control loop also including a monitor amplifier that provides a monitor voltage, said power supply further comprising:

a circuit for checking the continuity status of said sense lead when said power supply is in the disable mode and for applying a continuity voltage to said monitor amplifier input in accord with said continuity status of said sense lead.

2. The power supply according to claim 1 wherein said circuit includes a source of voltage and a resistor network; and wherein said resistor network is connected in circuit with said sense lead, said source of voltage and an input to said monitor amplifier, said resistor network, and said source of voltage is operative to apply said continuity voltage to said monitor amplifier input.

3. The power supply according to claim 2 wherein said continuity status has a first state and a second state indicative of continuity and discontinuity of said sense lead; and wherein said monitor amplifier provides a monitor voltage with first and second values corresponding to said first and second states, respectively.

4. The power supply according to claim 3 wherein said monitor amplifier is a differential amplifier, said input being a first of first and second inputs of said amplifier; and wherein said resistor network provides said continuity voltage to said first and second inputs as balanced voltages for said first state and unbalanced voltages for said second state.

5. The power supply according to claim 4 wherein said output of said power supply is a first of first and second output leads of said power stage;

wherein said sense lead is a first of first and second sense leads, said first and second sense leads being connected to said first and second output leads and to said resistor network;

wherein said continuity status has a third state indicative of discontinuity of said second sense lead, said first state being indicative of continuity of both said first and second sense leads;

wherein said continuity voltage has a first unbalanced voltage value for said second state and a third unbalanced voltage value for said third state; and wherein said monitor voltage has a third value corresponding to said third state.

6. The power supply according to claim 5 wherein said continuity status has a fourth state indicative of discontinuity of said first and second sense leads;

wherein said continuity voltage has a fourth unbalanced voltage value for said fourth state; and wherein said monitor voltage has a fourth value corresponding to said fourth state.

7. The power supply according to claim 6 wherein said first and second power supply outputs are coupled to circuit common during said disable mode; and wherein said resistor network provides a path for current flow from said voltage source to circuit common through any of said first and second sense leads that has continuity.

8. The power supply according to claim 7 wherein said resistor network provides another path for current flow from said voltage source to circuit common when any of said first and second sense leads has a discontinuity.

9. A constant voltage power supply including (a) an output that is adapted to be connected to a load, (b) a power stage coupled to said output and having an enable mode wherein an operating voltage is applied to said output, and a disable mode wherein said power stage is isolated from said output and (c) a control loop including a sense lead coupled to said output for monitoring said operating voltage and providing an error signal to said power stage for maintaining said operating voltage constant, said control loop also including a monitor amplifier that provides a monitor voltage, said power supply further comprising:

a circuit for checking the continuity status of said sense lead when said power supply is in the disable mode and for applying a continuity voltage to said monitor amplifier input in accord with said continuity status of said sense lead, said circuit comprising:

a source of voltage and a resistor network connected in circuit with said sense lead and first and second inputs to said monitor amplifier, said resistor network including (a) first and second resistors connected between said source of voltage and said first and second monitor amplifier inputs, respectively, (b) a third resistor connected between said first input and a circuit common, (c) a fourth resistor connected between said second input and an output of said monitor amplifier, and (d) a fifth resistor connecting said sense lead to one of said first and second monitor amplifier inputs.

10. The power supply according to claim 9 wherein said output of said power supply is a first of first and second output leads of said power stage;

wherein said sense lead is a first of first and second sense leads connected to said first and second output leads, respectively;

wherein said resistor network includes sixth and seventh resistors;

wherein said fifth and sixth resistors operatively connect said first and second sense leads to said first and second monitor amplifier inputs, respectively; and wherein said seventh resistor is connected in circuit with said second sense lead and said sixth resistor.

11. A method of operating a constant voltage supply, said method comprising:

enabling said power supply to provide an operating voltage to a load;

sensing the operating voltage at the load by means of a sense lead;

applying said sensed operating voltage to a feedback circuit for maintaining said operating voltage constant;

disabling said power supply from providing said operating voltage to said load; and checking the continuity status of said sense lead while said power supply is disabled by means of a voltage source and a resistor network connected in circuit with said feedback circuit.

12. The method according to claim 10, wherein said feed back circuit includes a monitor amplifier and an error circuit;

wherein said sensed operating voltage is applied to said error circuit via said monitor amplifier; and wherein said reisistive network and voltage source are connected in circuit with said monitor amplifier whereby the output of said monitor amplifier reflects said continuity status.

* * * * *